US009013103B2

(12) United States Patent
Meyer et al.

(10) Patent No.: US 9,013,103 B2
(45) Date of Patent: Apr. 21, 2015

(54) HIGH-PRESSURE DISCHARGE LAMP HAVING A STARTING AID

(75) Inventors: Klaus Meyer, Pollenfeld (DE); Konrad Regler, Hirnstetten (DE); Claus Pfaller, Walting-Inching (DE); Janbernd Hentschel, Eichstaett (DE)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 14/236,332

(22) PCT Filed: May 22, 2012

(86) PCT No.: PCT/EP2012/059425

§ 371 (c)(1),
(2), (4) Date: Jan. 31, 2014

(87) PCT Pub. No.: WO2013/017304

PCT Pub. Date: Feb. 7, 2013

(65) Prior Publication Data

US 2014/0167606 A1 Jun. 19, 2014

(30) Foreign Application Priority Data

Aug. 1, 2011 (DE) ..... 20 2011 103 945 U

(51) Int. Cl.

| | |
|---|---|
| ***H01J 11/00*** | (2012.01) |
| ***H01J 61/06*** | (2006.01) |
| ***H01J 65/00*** | (2006.01) |
| ***H01J 61/54*** | (2006.01) |
| ***H01J 61/34*** | (2006.01) |
| ***H01J 61/86*** | (2006.01) |

(52) U.S. Cl.

CPC ..... *H01J 61/547* (2013.01); *H01J 61/34* (2013.01); *H01J 61/86* (2013.01)

(58) Field of Classification Search

USPC ..... 313/567–643, 493, 318.12, 312, 324

See application file for complete search history.

(56) References Cited

U.S. PATENT DOCUMENTS

| | | | | |
|---|---|---|---|---|
| 3,634,718 | A | 1/1972 | Larson | |
| 4,053,809 | A | 10/1977 | Fridrich et al. | |
| 4,138,621 | A * | 2/1979 | Downing et al. | 313/113 |
| 4,721,888 | A * | 1/1988 | Proud et al. | 315/60 |
| 5,325,017 | A * | 6/1994 | Schellen et al. | 315/58 |
| 5,550,421 | A * | 8/1996 | Scholz et al. | 313/25 |
| 5,757,137 | A * | 5/1998 | Zhu | 315/73 |
| 5,911,919 | A | 6/1999 | Billings | |

(Continued)

FOREIGN PATENT DOCUMENTS

| | | |
|---|---|---|
| CH | 306778 | 7/1955 |
| CH | 504781 A | 4/1971 |

(Continued)

OTHER PUBLICATIONS

Machine translation of DE 202010011029 U1.*

(Continued)

*Primary Examiner* — Anne Hines
*Assistant Examiner* — Jose M Diaz

(57) ABSTRACT

A high-pressure discharge lamp having a starting aid and having a discharge vessel is disclosed, wherein the discharge vessel has two ends with seals, in which electrodes and possibly power supply lines are fastened, wherein the starting aid includes a wire system consisting of a core wire and a wrapping wire applied thereto, wherein the wrapping wire is a flat-pressed or flattened wire.

17 Claims, 5 Drawing Sheets

(56) References Cited

U.S. PATENT DOCUMENTS

| | | | | |
|---|---|---|---|---|
| 5,942,840 | A * | 8/1999 | Steere et al. | 313/25 |
| 6,563,267 | B1 * | 5/2003 | Van Den Nieuwenhuizen et al. | 313/594 |
| 6,624,580 | B2 | 9/2003 | Kanegae et al. | |
| 6,713,961 | B2 * | 3/2004 | Honda et al. | 313/607 |
| 7,164,226 | B2 * | 1/2007 | Kai et al. | 313/284 |
| 8,227,990 | B2 | 7/2012 | Buttstaedt et al. | |
| 8,427,056 | B2 * | 4/2013 | Utsubo et al. | 313/631 |
| 8,659,225 | B2 * | 2/2014 | Panyik et al. | 313/594 |
| 2003/0034738 | A1 | 2/2003 | Kanegae et al. | |
| 2003/0076041 | A1 * | 4/2003 | Honda et al. | 313/634 |
| 2008/0224614 | A1 * | 9/2008 | Woods et al. | 313/625 |
| 2008/0303402 | A1 * | 12/2008 | Li et al. | 313/250 |
| 2012/0019133 | A1 * | 1/2012 | Graham et al. | 313/573 |
| 2012/0223638 | A1 * | 9/2012 | Brauner et al. | 313/623 |
| 2013/0093310 | A1 * | 4/2013 | Boroczki | 313/54 |

FOREIGN PATENT DOCUMENTS

| | | | |
|---|---|---|---|
| DE | 2105184 | A1 | 8/1971 |
| DE | 102005003129 | A1 | 7/2006 |
| DE | 202006016189 | U1 | 2/2007 |
| DE | 202010011029 | U1 | 11/2010 |
| DE | 202009013182 | U1 | 12/2010 |
| DE | 102009047861 | A1 | 3/2011 |
| DE | 202010016865 | U1 | 4/2011 |
| DE | 102010001209 | A1 | 7/2011 |
| EP | 2306492 | A1 | 4/2011 |
| GB | 1234166 | | 6/1971 |
| JP | 2003317663 | A | 11/2003 |
| WO | 2006076879 | A1 | 7/2006 |
| WO | 2008007284 | A2 | 1/2008 |
| WO | 2008049742 | A2 | 5/2008 |
| WO | 2011092146 | A1 | 8/2011 |

OTHER PUBLICATIONS

English machine translation of DE 20 2010 016 865 of Apr. 14, 2011 obtained on Feb. 14, 2014 from Espacenet.

English machine translation of CH 306 778 of Jul. 1, 1955 obtained on Feb. 14, 2014 from Espacenet.

English machine translation of DE 20 2010 011 029 of Nov. 25, 2010 obtained on Feb. 14, 2014 from Espacenet.

* cited by examiner

HIGH-PRESSURE DISCHARGE LAMP HAVING A STARTING AID

RELATED APPLICATIONS

The present application is a national stage entry according to 35 U.S.C. §371 of PCT application No.: PCT/EP2012/059425 filed on May 22, 2012, which claims priority from German application No.: 20 2011 103 945.9 filed on Aug. 1, 2011, and is incorporated herein by reference in its entirety.

TECHNICAL FIELD

Various embodiments relate to a high-pressure discharge lamp. Such lamps are in particular high-pressure discharge lamps for general lighting or for photooptical purposes.

BACKGROUND

DE 10 2009 047 861 discloses a high-pressure discharge lamp having a discharge vessel, in which a starting aid is used at the end of the discharge vessel.

Free electrons need to be generated in the discharge vessel for starting high-pressure discharge lamps. Until now, this has been provided by radioactive krypton-85 in the filling gas. Gas discharge lamps without radioactivity in the filling gas can start much more reliably when starting aids are used, for example a UV enhancer.

When the lamp geometry does not permit an additional starting aid, sometimes a discharge in an outer bulb can be used as a UV light source; see US 2003034738, WO2008007284. By suitably selecting the gas in the outer bulb, the outer bulb discharge usually has a lower starting voltage than the lamp. However, these voltages are still higher than the starting voltages of lamps filled with radioactive krypton-85.

Other known starting aids require more or less high starting voltages depending on the embodiment; see EP-A 2306492.

SUMMARY

Various embodiments provide a high-pressure discharge lamp which can be started using simple inexpensive means. This applies in particular to metal halide lamps, wherein the material of the discharge vessel can be ceramic or quartz glass. An application in xenon high-pressure discharge lamps or else mercury high-pressure discharge lamps is also possible, for example.

Various embodiments relate to high-pressure discharge lamps having a discharge vessel consisting of quartz glass or ceramic, possibly with an outer bulb. The present disclosure relates in particular to discharge lamps which are started with the aid of a starting pulse of the order of typically 4 to 5 kV, without a radioactive admixture.

A solution is described which, by means of a simple inexpensive design, ensures effective starting of such radioactivity-free lamps even with comparatively low starting pulses.

The present disclosure is applicable in particular for discharge lamps for general lighting which generally have a gas-filled outer bulb and are designed for lives of 6000 h or more.

Such high-pressure discharge lamps are started with the aid of special starting devices. The starting properties of these starting devices are fixed by corresponding standards. The conditions in the discharge vessel (volume, electrode spacing, filling gas, filling pressure, Hg quantity, quantity and type of metal halides) need to be matched to one another in such a way that the lamp safely starts given the established starting conditions. Furthermore, the required voltage for starting increases as the life increases. This can mean that old lamps no longer start on conventional starting devices. However, the starting capacity needs to be ensured over the entire life.

Various embodiments provide a solution which ensures safe starting for high-pressure discharge lamps. UV radiation is used for reliable starting of krypton-85-free high-pressure discharge lamps.

If the lamp geometry does not permit an additional light source, a discharge in an outer bulb can be used as UV light source. Advantageous here in particular is a dielectrically impeded discharge, in which only an auxiliary starting electrode is in contact with the outer bulb gas. It is advantageous for the starting voltage of the outer bulb discharge if free electrons can be generated by field emission. For this, high electrical fields need to be generated on the auxiliary starting electrode. A further aim of the disclosure consists in generating field intensity maxima in the outer bulb inexpensively.

A considerable reduction in the starting voltage in the outer bulb can be achieved by using the field emission of electrons from an auxiliary starting electrode. For this, a maximum possible number of locations with a high electrical field intensity needs to be generated on the auxiliary starting electrode.

Field intensity maxima are produced on the auxiliary starting electrode at locations with pronounced surface curvature. These can be peaks or ridges produced during production. These are often poorly reproducible. In the case of the simple auxiliary starting wires having a cylindrical cross section which are often used, these ridges are only produced at the ends. In this case, only small areas contribute to the start of the outer bulb discharge, and this discharge is therefore only effective to a low degree.

U.S. Pat. No. 6,624,580 describes how a suitable outer bulb filling gas can be excited with the aid of a dielectrically impeded discharge such that sufficient UV radiation is generated for starting the lamp. The starting voltages required for this are in the range of from 10 to 20 kV, however, with the result that this method cannot be used for discharge lamps which are intended to start on a starting pulse of 3-5 kV.

In a particular embodiment of the present disclosure, an outer bulb of the lamp is filled with a gas which is suitable for forming a corona discharge, for example Ar, Xe or else air, but also other gases or gas mixtures. The filling pressure can in this case be between 1 bar and 0.1 mbar. Alternatively, a discharge vessel can also be operated directly in air, i.e. without an outer bulb.

A suitable design of an arrangement according to the disclosure provides for an electrically conductive arrangement which has one or more very small radii or sharp edges and is electrically conductively connected to the power supply line of the other electrode (contacted variant), to be fitted externally at the end of the discharge vessel as close as possible to the electrode. Alternatively, the auxiliary starting arrangement can also be electrically conductively connected to an identical or similar arrangement on the other side of the discharge vessel without contact with one of the two power supply lines (capacitively coupled variant).

A particularly simple form of the disclosure in the contacted variant provides for a thin wire with a starting aid to be attached to one end of the discharge vessel in such a way that it is positioned as close as possible to the first electrode, as a turn or loop or a group thereof, and for a second turn or loop or group thereof connected thereto to be connected to the power supply line of the second electrode. Close contact of the link between the two groups in the central region of the discharge vessel is not necessary.

As capacitively coupled variant, a wire is thus positioned at both ends of the discharge vessel in such a way that each wire end is brought as tightly as possible to an electrode or leadthrough as turn or loop or a group thereof.

Furthermore, an asymmetrical design is possible which envisages an arrangement for the formation of the corona discharge only on one side of the discharge vessel and as effective capacitive coupling as possible on the other side.

The present disclosure enables very simple technical arrangements with which discharge lamps having the above-mentioned properties start safely using starting devices with a starting pulse of 3-5 kV. Particularly advantageously, the disclosure is used for sodium-containing lamps in the capacitively coupled variant.

The starting aid according to the disclosure is much more effective than a conventional starting aid with a similar design since a corona discharge forms at the structure of a starting aid even at lower voltages than a dielectrically impeded discharge.

The effectiveness of a starting aid in the case of pinch-sealed burners is often not very high since the auxiliary starting arrangement needs to be passed around the entire pinch seal and the pinch seal takes up a large cross-sectional area, with the result that the induced electrical fields are only small. Fuse seals are therefore more suitable. The proposed disclosure makes it possible to position a starting aid in a targeted manner in the vicinity of at least one foil in the end of the discharge vessel, with the result that a comparatively large electrical field is induced here. In the known designs of starting aids, the distance between the electrode and wall inner face of the discharge vessel in the region of the starting aid is critical to the effectiveness since a discharge is induced in this region. In particular in the case of a discharge vessel consisting of quartz glass, however, this distance can only be reproduced with difficulty. As a result, the effectiveness of the starting aid as well is subject to corresponding fluctuations. In the present disclosure, a discharge is generated outside the discharge vessel. The distance relevant here, namely the distance from the outer wall of the discharge vessel, can be set easily and can be kept constant in a simple manner in terms of manufacturing technology.

The design of the starting aid is simple and relatively inexpensive since, for example, only one wire with a virtually cylindrical geometry is required. By virtue of the attachment externally on the discharge vessel, both the discharge vessel and the outer bulb can be produced in accordance with conventional methods without any changes.

The auxiliary starting component is only arranged at the ends of the discharge vessel, with the result that it is not subjected to temperature loading which is as high as that for component parts which are in contact with the discharge vessel in the central part. Thus, the choice of materials is simplified.

Since it is preferably a thin wire construction, the light emerging from the discharge vessel is shielded to a markedly lesser extent than in other auxiliary starting constructions.

In order to achieve a particularly low starting voltage, it is necessary to generate a particularly high field intensity at the starting aid. This can be achieved firstly by reducing the diameter of the wire of the starting aid. However, in the process the stability with respect to external influences is at the same time reduced. It is necessary therefore to configure a starting aid such that, firstly, it can generate high electrical field intensities, but secondly it nevertheless has a sufficiently high stability. In addition, it should be easy to manufacture. This object is relevant in principle in many lamps in which spontaneous discharge is intended to act as starting aid. Applications are in particular metal halide lamps having a discharge vessel consisting of quartz glass or ceramic, or else xenon high-pressure discharge lamps or mercury high-pressure discharge lamps. In addition, an application area is the mating electrode or external electrode of a UV enhancer for such lamps.

In a preferred embodiment, the starting aid is a wire construction with a round, i.e. cylindrical core wire, around which a flat-pressed wire as wrapping wire is wound. The individual turns are spaced apart from one another with a defined pitch. Preferably, a pitch s of the wrapping wire is from 1 to 10 times, preferably from two to five times, its width R.

The application of the wrapping wire onto the core wire is performed using known winding machines, wherein, by means of plastic deformation during the winding operation, the narrow sides of the wrapping wire to be applied to the core wire lift off from the core wire and in the process protrude out of the surrounding environment of the assembly including the core wire and the wrapping wire. Alternatively, an already correspondingly preformed stock material for the wrapping wire can also be applied to the core wire.

The narrow sides or else edges of the wrapping wire are therefore spaced apart from the core wire and do not rest against said core wire. The distance X should be as large as possible. In general, values for X of from 10 to 40% of B can be realized, where B is the thickness of the wrapping wire.

The radius of the edges of the stock material for the wrapping wire should be selected to be as small as possible and preferably have a value of at most 20% of the radius D/2 of the core wire, but at most should be exceed a maximum value of 10 μm.

The advantages of this particularly preferred embodiment are that, given a stable configuration, high electrical field intensities can be achieved. As a result, the starting of the lamp is simplified and low starting voltages are sufficient. The reliability of the starting properties with respect to predetermined limits and with respect to other process influences is increased. This type of starting aid can be machine-processed very easily since the diameter of the core wire can be selected to be large (typically 50 μm to 400 μm) without the effect of field boosting originating from the wrapping wire being impaired thereby.

The machineability is good because the intermediate product, i.e. the starting aid, can be considered to be virtually radially symmetrical and can therefore be processed in the same way as a simple round wire on known machines.

A high-pressure discharge lamp having a starting aid and having a discharge vessel is disclosed, wherein the discharge vessel has two ends with seals, in which electrodes and possibly power supply lines are fastened, characterized in that the starting aid includes a wire system consisting of a core wire and a wrapping wire applied thereto, wherein the wrapping wire is a flat-pressed or flattened wire.

In a further embodiment, the high-pressure discharge lamp is configured such that the wire system of the starting aid is wound with one or more turns, wherein in particular at least one turn is wound onto at least one end of a discharge vessel.

In a still further embodiment, the discharge vessel is surrounded by an outer bulb, wherein the starting aid is accommodated in the outer bulb, and wherein the starting aid includes an electrode and a power supply line.

In a still further embodiment, the outer bulb is filled with ionizable gas.

In a still further embodiment, the wire system of the starting aid is wound with at least one turn, wherein at least one turn is wound onto at least one end of the discharge vessel, wherein the discharge vessel is the only bulb of the lamp.

In a still further embodiment, the core wire is cylindrical with a given diameter D.

In a still further embodiment, the wrapping wire is wound with a pitch s onto the core wire.

In a still further embodiment, the wrapping wire has a width a, wherein s=1a to 10a, in particular 2a to 5a.

In a still further embodiment, the core wire has a diameter D of from 5 to 400 μm, preferably 50 to 200 μm.

In a still further embodiment, the wrapping wire has at least one narrow side or edge which protrudes from the core wire, in particular two narrow sides or edges which both protrude from the core wire.

In a still further embodiment, the starting aid has a UV enhancer with a vessel with an inner electrode, wherein the wire system of the starting aid acts as a mating electrode with respect to the inner electrode, said mating electrode being fitted externally on the vessel of the starting aid, wherein in particular the outer bulb of the lamp is evacuated.

In a still further embodiment, the starting aid is galvanically or capacitively coupled.

In a still further embodiment, the starting aid has a material which has a low electron work function.

In a still further embodiment, the starting aid is fitted at least at the height of a film in the region of the end of the discharge vessel.

In a still further embodiment, the gas in the outer bulb has a cold filling pressure of from 0.1 mbar to 300 mbar, wherein the starting aid generates a corona discharge in this gas which emits UV radiation into the discharge vessel.

In a still further embodiment, the starting aid includes two groups of turns, to be precise in each case at least one turn on both ends of the discharge vessel, wherein the two groups of turns are connected to one another via an electrically conductive link.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
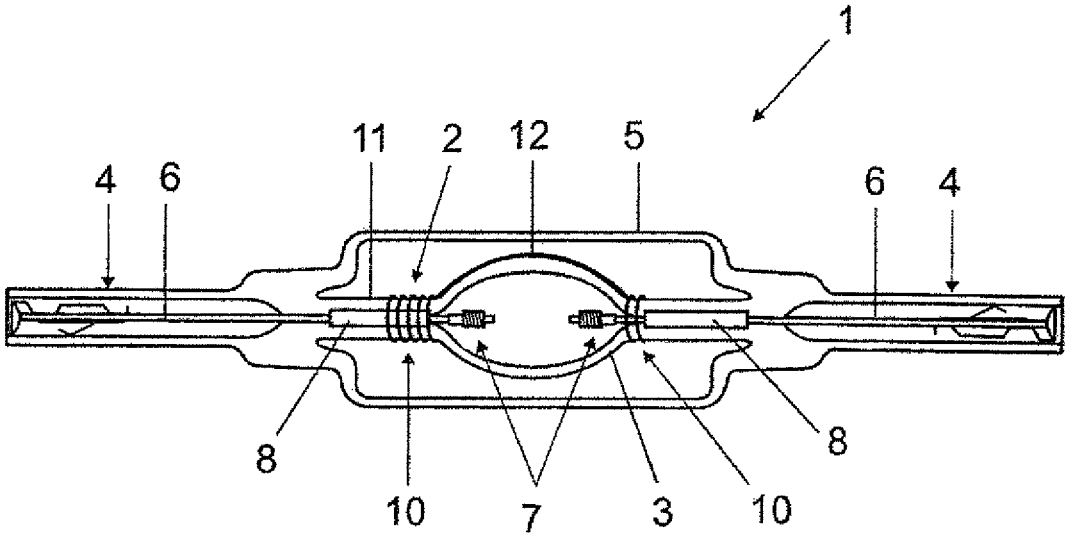
FIG. 1 shows a high-pressure discharge lamp having a starting aid, first embodiment.

FIG. 1 shows a schematic of the basic design of a high-pressure discharge lamp 1 having a starting aid 2. It has a discharge vessel 3 consisting of quartz glass and having two ends 4, wherein an outer bulb 5 is fitted onto the ends 4. The discharge vessel 3 has outer power supply lines 6, which make contact with electrodes 7 in the interior. The ends are fuse seals which contain a foil 8. The discharge vessel 3 has a fill consisting of an ionizable gas, generally argon or xenon, mercury and metal halides, as known per se.

The outer bulb is filled with argon with a coldfilling pressure of from 1 mbar to 200 mbar.

The starting aid 2 is fastened, in the form of two groups 10 of turns of a wire, for example consisting of Mo or W or containing one of these metals, on the inner parts of the ends which are in the form of seals 11. The two groups 10 are connected to one another via a wire link 12. Alternatively, it is also possible to use an alloy which contains iron, in particular an alloy of Fe/Cr/Al.

In principle, the starting aid 2 is in the form of a wire which, at least in relation to an end of the discharge vessel, has a center which boosts the electrical field intensity.

Figure 2:
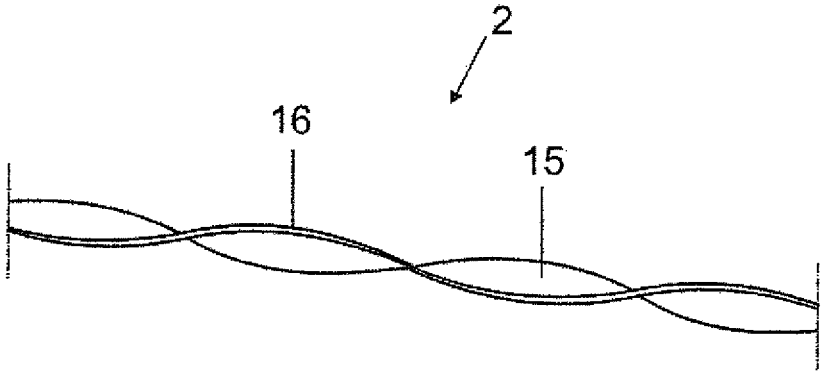
FIG. 2 shows a detail view of an embodiment of a starting aid.

FIG. 2 shows an embodiment of a starting aid 2, wherein the wire 15 is rolled flat and a lateral edge 16 for boosting starting is thus formed. In particular, the wire 15, as illustrated, is also additionally twisted. During rolling, a thickness of the wire of approximately 30 to 120 μm is achieved; the rolled wire is even much thinner at the edges, typically by a factor of 2 to 5. This embodiment demonstrates high stability and starting-promoting effect, but is relatively cost-intensive from the point of view of fitting and processing of the wire. A further embodiment is a wire which has a rectangular cross section and has a relatively small radius of curvature at the edges.

Instead of rolling, in general ridges can be produced on a section of the starting aid with the aid of an embossing structure. This can be applied inexpensively in the form of knurling, scrapping (see in this regard the technology as described in DE202006016189U1), sandblasting or another method for surface structuring. In this case, however, care should be taken to ensure that no notable local cross-sectional reduction in the wire and therefore reduced mechanical stability occurs. The particular advantage of this method of embossing consists in that it is a technique which is very well known per se, which is easily reproducible and which can be adjusted very precisely to the specific requirements.

Figure 3:
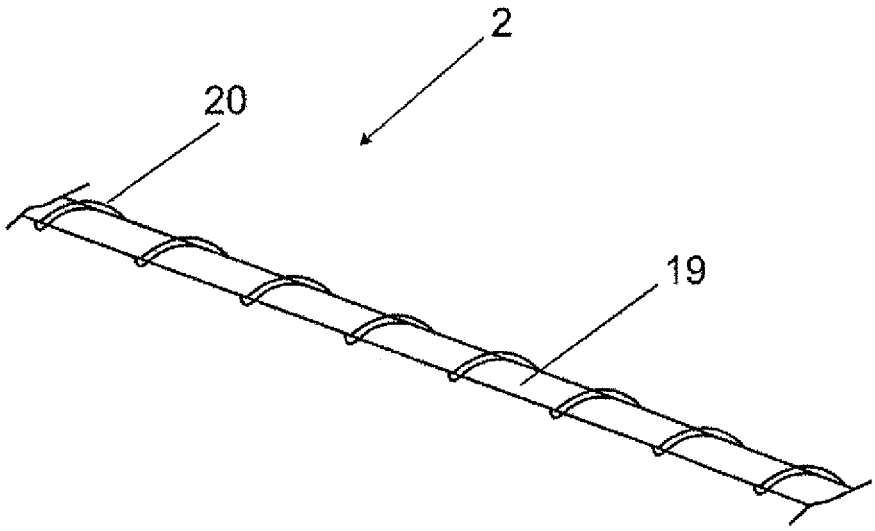
FIG. 3 shows a further embodiment of a starting aid.

FIG. 3 shows a further embodiment of a starting aid 2, namely a wire 19, which acts virtually as core wire, around which a fine wire 20 as wrapping wire is to be turned. In this case, the fine wire 20 ensures the small radii of curvature and therefore high field intensities without the mechanical properties of the starting aid being negatively influenced thereby. Therefore, such a design is very well suited to the groups of turns. The diameter of the wrapping wire 20 is advantageously in the range of from 10 to 150 μm. The diameter of the core wire 19 to which the wrapping wire is applied is typically in a range from 0.1 to 3 mm.

In particular, the core wire or wrapping wire can be rolled to form a thin foil which then has a lens-shaped cross section.

Figure 4:
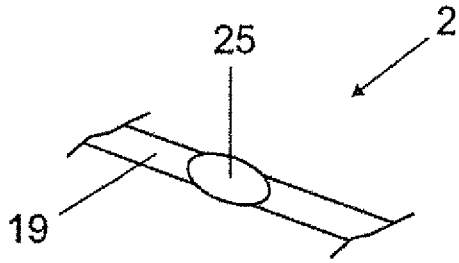
FIG. 4 shows a further embodiment of a starting aid.

In another embodiment, the starting aid 2 is a wire 19 which is provided with at least one flattened section 25 (FIG. 4).

Further forms of twisting or turning of wires are possible. Similarly, thin-rolled foils with correspondingly sharp edges can likewise be twisted. The field boosting resulting from ridges is in principle applicable for all metals. Particularly advantageous in combination with geometry variations, are metals and compounds which are characterized by a low work function (see U.S. Pat. No. 5,911,919, for example). It is sufficient for the variant of the core wire around which a wrapping wire is spun if the wrapping wire consists of a material with a low work function or is coated with such a material. Emissive materials are in particular carbides or borides of Hf, Zr, Ti, in particular as a layer of wires or introduced into a matrix on the basis of metals such as W, Ta, Re or else Mo.

By virtue of the configuration of the starting aid described in the disclosure, it is possible to avoid radioactivity in the filling gas even in lamps in which no additional UV light source can be used. Lamps without radioactivity having simple starting aids which are not in accordance with the disclosure already achieve lower starting voltages than those completely without a starting aid. However, these are still above those of lamps with radioactivity. A direct replacement on the market without changing the operating device is therefore not always possible. Only by virtue of the configuration according to the disclosure of the starting aid, i.e. the targeted, reproducible introduction of locations with a small surface curvature (ridges, peaks, edges), is this possible.

Such profiling of a wire results in a reduction in the starting voltage. Depending on the nature and position of the profiled section, a noticeable reduction in the starting voltage is thus achieved. Instead of 4 kV, without a profile, now only approximately 3 kV are required.

A typical length of such a section 25 is 0.5 to 5 mm.

In a preferred embodiment, the starting aid is purely capacitive. This is dependent on the fact that the effective structure is fitted as close as possible to the discharge vessel, to be precise preferably in the region of the foils at the ends of the discharge vessel. The effective structure can in this case be located in the region of a foil, or alternatively can extend in the region of both foils or extend over the entire length of the starting aid.

Figure 5:
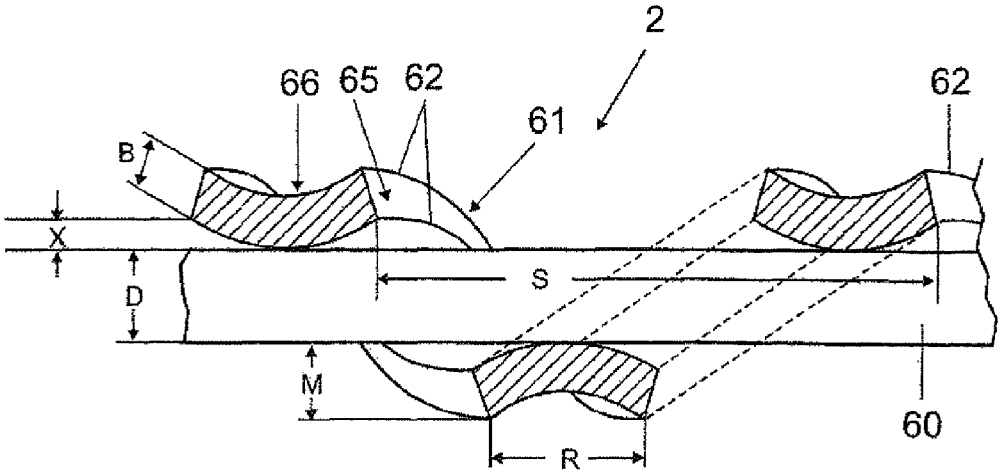
FIG. 5 shows a further embodiment of a starting aid.

FIG. 5 shows an embodiment of a starting aid 2, in which the core wire is a round wire 60, and in which the wrapping wire 61 has, in principle, a rectangular cross section. It has narrow sides 65 and broad sides 66 with edges 62 inbetween and is deformed in such a way that the edges 62 achieve a distance X from the core wire which is as great as possible. Thus, very considerable starting boosting can be achieved because the edges are outside the electrical field governed by the core wire.

In the best case scenario, the maximum distance M of the edges is of the order of magnitude D of the diameter of the core wire. If a foil or rolled wire is used as wrapping wire, then the narrow sides 65 and edges 62 of the wrapping wire are bent even further away from the core wire 60. Using this technique, typically a distance M of approximately 0.5 to 1.5 D can be achieved. In addition, the thickness B of the wrapping wire should be selected to not be excessively large in order that the wrapping wire can be bent and deformed easily.

Good results are achieved with a core wire diameter of 100 to 300 μm if, at the same time, the wrapping wire has a substantially rectangular cross section, at least approximately, with a maximum thickness B of approximately 50 to 100 μm and a maximum width R of 100 to 300 μm. The approximated rectangular cross section of the wrapping wire is in particular also achieved by flattening of a wire, in which case only one edge instead of two edges 62 exist on the narrow side.

Figure 6:
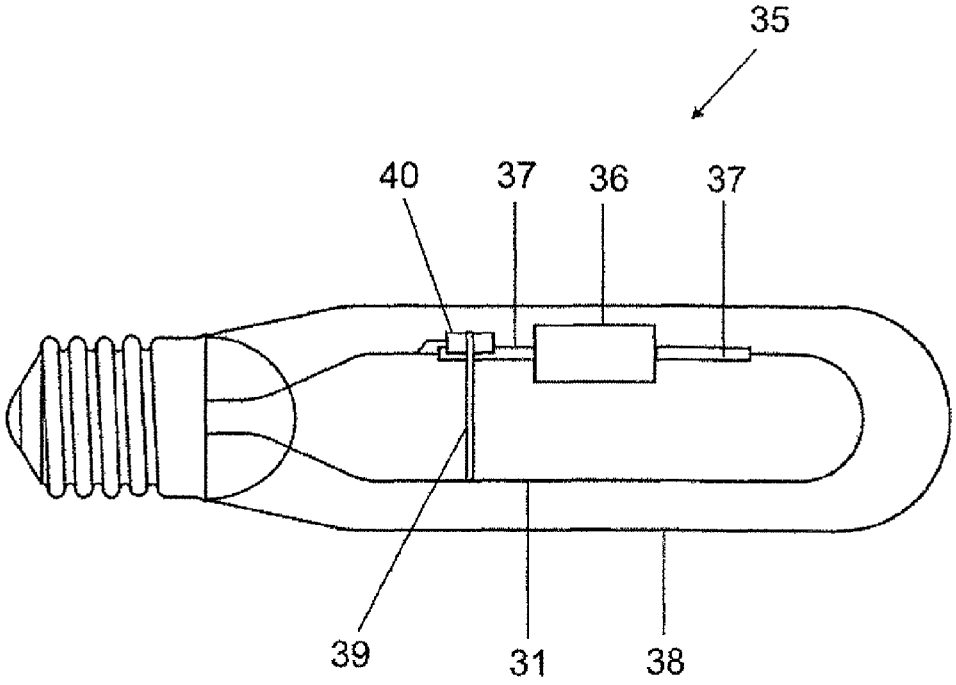
FIG. 6 shows a high-pressure discharge lamp having a UV enhancer using an electrode according to the disclosure.

FIG. 6 shows a further application of the starting aid in a high-pressure discharge lamp 35, in which a discharge vessel 36 consisting of ceramic is provided with two ends 37, which are in the form of capillaries. An outer bulb 38 surrounds the discharge vessel at a distance. The starting aid itself is in this case a UV enhancer 40, which is fitted in the vicinity of a capillary 37. In this case, the UV enhancer functions in accordance with the principle of dielectrically impeded discharge with an inner electrode, wherein an external mating electrode 39 extends from a bow-shaped wire 31 of the frame which holds the discharge vessel in the direction of the UV enhancer 40. The mating electrode is a foil strip 39, which rounds off the UV enhancer and in the process provides a semicircular contact zone.

Figure 7A:
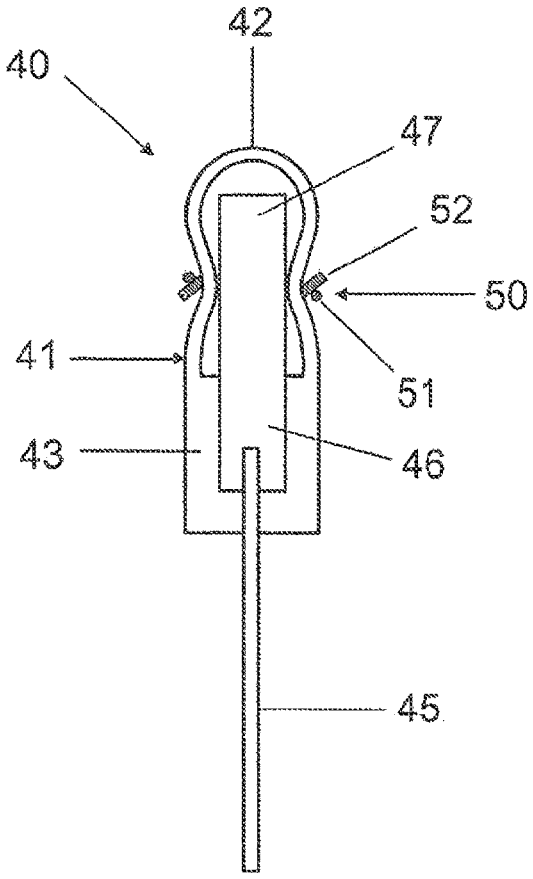
FIGS. 7A and 7B show an embodiment of a UV enhancer with an electrode according to the disclosure in two variants.

FIG. 7A shows a first embodiment of the UV enhancer 40. It has a vessel 41 consisting of quartz glass. The vessel 41 is in the form of a can with a dome 42 and a pinch seal 43. The vessel is filled with argon and another UV-emitting substance, as is known per se.

A feed line 45, which ends in a foil 46 consisting of molybdenum, protrudes into the pinch seal 43. The foil 46 extends as far as into the interior of the vessel and forms an inner electrode 47 there. At the same time, it imparts the sealing effect of a leadthrough in the pinch seal. In accordance with the principle of dielectrically impeded discharge, a mating electrode 50, which is substantially a core wire 51 with a wrapping wire 52, in this case flattened, is fitted externally on the vessel. In this case, in particular a structure as illustrated in FIG. 5 is preferred.

Figure 7B:
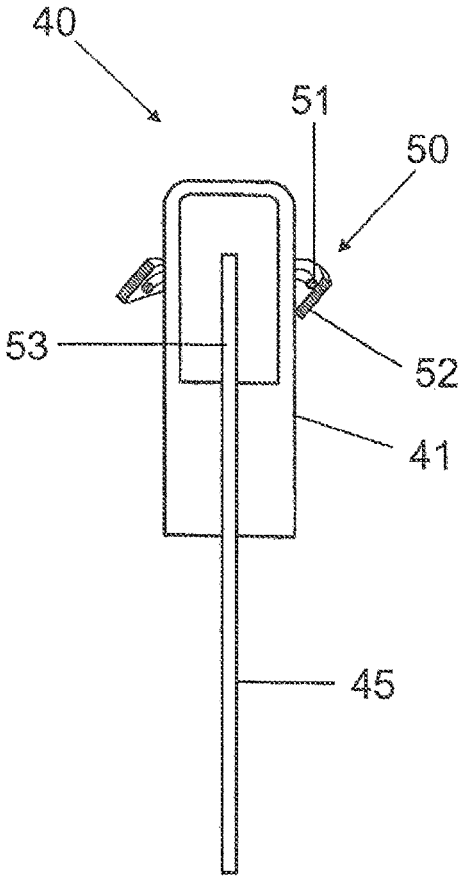

A similar embodiment of a UV enhancer is shown in FIG. 7B. In said figure, the vessel 41 consists of hard glass and the inner electrode 53 is in the form of a pin. It is connected directly to the feed line 45.

Figure 8:
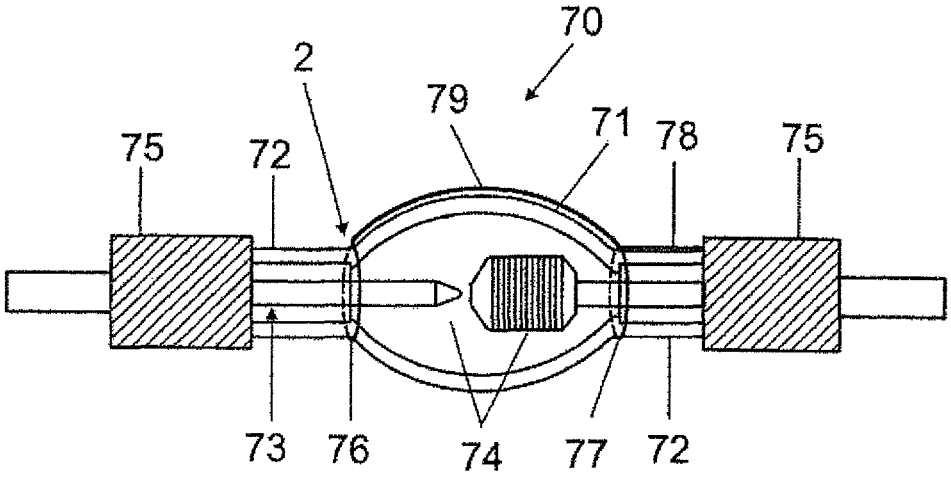
FIG. 8 shows an embodiment of a xenon high-pressure discharge lamp having a starting aid.

FIG. 8 shows a xenon high-pressure discharge lamp 70 having a discharge vessel 71 consisting of hard glass and two ends 72, which are in the form of fuse seals. An electrode system 73 is passed to the outside through the fuse seal. It ends internally at two electrodes 74. Metal bases 75 rest on both ends. A starting aid 2 is in this case in the form of a loop 76 on the first end 72, wherein a second loop 77 rests on the second end 72. Both loops are connected via a link 79. This can be a simple wire, while the loops themselves are embodied in particular in accordance with the embodiments shown in FIG. 3, 4 or 5 and thus ensure starting boosting. The galvanic coupling is achieved by a wire 78, which connects a loop 77 to the associated base 75.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A high-pressure discharge lamp having a starting aid and having a discharge vessel, wherein the discharge vessel has two ends with seals, in which electrodes and possibly power supply lines are fastened, wherein the starting aid comprises a wire system consisting of a core wire and a wrapping wire applied thereto, wherein the wrapping wire is a flat-pressed or flattened wire, wherein the wrapping wire is wound with a pitch s onto the core wire.

2. The high-pressure discharge lamp as claimed in claim 1, wherein the wire system of the starting aid is wound with one or more turns, wherein at least one turn is wound onto at least one end of a discharge vessel.

3. The high-pressure discharge lamp as claimed in claim 1, wherein the discharge vessel is surrounded by an outer bulb, wherein the starting aid is accommodated in the outer bulb, and wherein the starting aid comprises an electrode and a power supply line.

4. The high-pressure discharge lamp as claimed in claim 3, wherein the outer bulb is filled with ionizable gas.

5. The high-pressure discharge lamp as claimed in claim 1, wherein the wire system of the starting aid is wound with at least one turn, wherein at least one turn is wound onto at least one end of the discharge vessel, wherein the discharge vessel is the only bulb of the lamp.

6. The high-pressure discharge lamp as claimed in claim 1, wherein the core wire is cylindrical with a given diameter.

7. The high-pressure discharge lamp as claimed in claim 1, wherein the wrapping wire has a width a, wherein s=1a to 10a, in particular 2a to 5a.

8. The high-pressure discharge lamp as claimed in claim 6, wherein the core wire has a diameter of from 5 to 400 μm.

9. The high-pressure discharge lamp as claimed in claim 1, wherein the wrapping wire has at least one narrow side or edge which protrudes from the core wire.

10. The high-pressure discharge lamp as claimed in claim 3, wherein the starting aid has a UV enhancer with a vessel with an inner electrode, wherein the wire system of the starting aid acts as a mating electrode with respect to the inner electrode, said mating electrode being fitted externally on the vessel of the starting aid, wherein the outer bulb of the lamp is evacuated.

11. The high-pressure discharge lamp as claimed in claim 1, wherein the starting aid is galvanically or capacitively coupled.

12. The high-pressure discharge lamp as claimed in claim 1, wherein the starting aid has a material which has a low electron work function.

13. The high-pressure discharge lamp as claimed in claim 2, wherein the starting aid is fitted at least at the height of a film in the region of the end of the discharge vessel.

14. The high-pressure discharge lamp as claimed in claim 3, wherein the gas in the outer bulb has a coldfilling pressure of from 0.1 mbar to 300 mbar, wherein the starting aid generates a corona discharge in this gas which emits UV radiation into the discharge vessel.

15. The high-pressure discharge lamp as claimed in claim 2, wherein the starting aid comprises two groups of turns, wherein the two groups of turns are connected to one another via an electrically conductive link.

16. The high-pressure discharge lamp as claimed in claim 9, wherein the wrapping wire has two narrow sides or edges which both protrude from the core wire.

17. The high-pressure discharge lamp as claimed in claim 15, wherein the starting aid has at least one turn on both ends of the discharge vessel.

* * * * *